US007367449B2

(12) United States Patent
Kaminski et al.

(10) Patent No.: US 7,367,449 B2
(45) Date of Patent: May 6, 2008

(54) CASE WITH TWO SIDES AND INTERLOCKING LATCH

(76) Inventors: Scott T. Kaminski, 121 Samoa Ct., San Ramon, CA (US) 94583; Curtis L. Anderson, 33 Upper Golf Rd., Pleasanton, CA (US) 94566

( * ) Notice: Subject to any disclaimer, the term of this patent is extended or adjusted under 35 U.S.C. 154(b) by 92 days.

(21) Appl. No.: 10/760,695

(22) Filed: Jan. 20, 2004

(65) Prior Publication Data

US 2004/0154935 A1 Aug. 12, 2004

Related U.S. Application Data

(60) Provisional application No. 60/441,869, filed on Jan. 21, 2003.

(51) Int. Cl.
*A45C 11/04* (2006.01)

(52) U.S. Cl. ..... 206/6.1; 206/1.5; 206/566

(58) Field of Classification Search ..... 70/159, 70/160, 161, 162; 206/1.5, 6.1, 523, 566, 206/315.11; 220/324, 327, 839, 504
See application file for complete search history.

(56) References Cited

U.S. PATENT DOCUMENTS 2,680,535 A * 6/1954 Thon ..... 220/326
3,061,136 A * 10/1962 Sterngart ..... 220/504
3,499,525 A * 3/1970 Kanter ..... 206/379
3,651,983 A * 3/1972 Haugen ..... 220/326
D254,122 S * 2/1980 Wintz ..... D3/224
4,730,731 A * 3/1988 Allison ..... 206/540
5,035,319 A * 7/1991 Kunisch ..... 206/6.1
5,638,957 A * 6/1997 Brasier ..... 206/581
D436,727 S * 1/2001 Hsu ..... D3/294
6,450,333 B1 * 9/2002 McClenahan et al. . 206/315.11
6,520,331 B2 * 2/2003 Okin et al. ..... 206/494

* cited by examiner

*Primary Examiner*—David T. Fidei
(74) *Attorney, Agent, or Firm*—George W. Wasson

(57) ABSTRACT

A case for carrying and storing flexible objects including elongated and small objects in a manner which prevents or reduces the objects from becoming tangled. The case is a two sided case with a central plate or base with each side having an openable lid. The lids are hinged at one side of the case and the lids and base include a latching mechanism for each lid. The exterior of the lids are rigid while the interior of the base and the lids include flexible materials that secure the objects within the case when the lids are closed and provide ease of access to objects when the a lid is open. The latching mechanism includes cooperating elements that permit opening one lid only when that lid is above the base and prevent opening a lid when another lid is open. A locking system secures the lids in closed position.

13 Claims, 8 Drawing Sheets

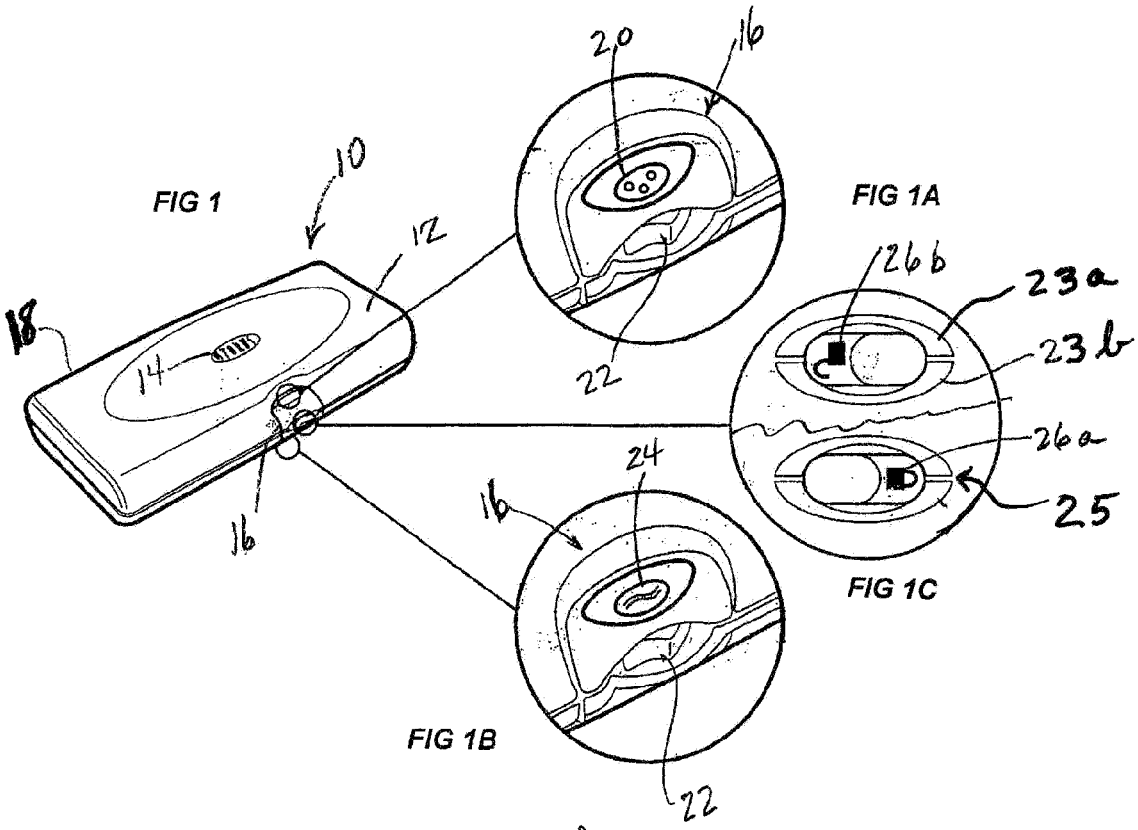
FIG 1
FIG 1A
FIG 1B
FIG 1C
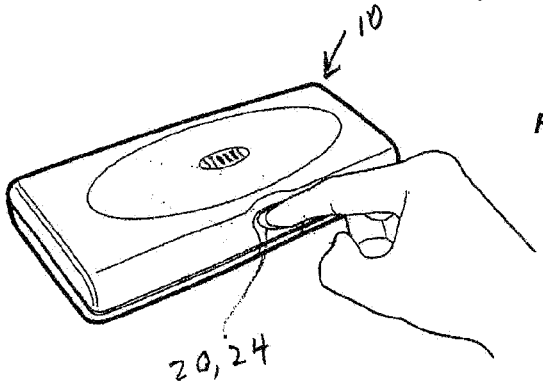
FIG 2

CASE WITH TWO SIDES AND INTERLOCKING LATCH

CROSS REFERENCE TO RELATED APPLICATIONS

This application claims priority of Provisional Application No. 60/441,869 filed Jan. 21, 2003.

FIELD OF THE INVENTION

This invention relates to a case for carrying and storing elongated objects and small separated objects. More specifically, it relates to a case used for carrying elongated objects (such as, necklaces with flexible chains, charms, pendants, finger rings, earrings, and other small objects) in a manner which prevents or reduces the objects from becoming damaged or tangled.

SUMMARY OF THE INVENTION

An embodiment of the present invention includes a case comprised of a two sided storage body with each side of the body enclosed by an openable cover. The two covers are connected by a hinge. The body is attached to the hinge between the covers via a hinge sleeve. The body also includes a joint locking mechanism for each cover. The locking mechanism permits both covers to be locked in a closed position. A latching mechanism permits one cover to be opened but prevents the opening of both covers at the same time. The case is adapted to be placed flat on a surface and actuated to permit the top surface cover to be opened to permit access to the interior of that side of the storage body. When that cover is closed, the case may be placed with the opposite cover exposed and then the second cover may be opened by actuation. When both covers are closed, the covers can be locked to prevent accidental or inadvertent opening of either side cover of the case.

Each cover of the case is hinged to a side of the case and the hinge includes controlled opening of the cover by causing the cover to be opened under a damped biasing force and damped at a limited speed of that opening. The opening of the cover is under a driving force, but that force is controlled so that the cover opens slowly from its unlatched position to its fully opened position.

The hinged mounting and controlled opening of each cover permits the user to place the case on a surface and them merely press the latch for the cover at that side with a single finger. The unlatched cover them opens slowly to its fully open position. The need to use both hands to open the case is eliminated.

The interior of the case, on both sides, is finished with resilient materials and suitable partitions to hold the articles within the case in their stored position. Of particular concern for the elimination of tangling of necklace strands is the interior formation of one side with prongs or barriers that permit the user to lace a necklace through the prongs or barriers to separate that necklace from others within the case. The interior surface of the covers are finished with resilient materials that softly compress against the base of that side when the cover is closed to retain the necklace or other flexible articles in place in their stored position and thus prevent entanglement with other articles in that compartment.

The storage area interior of the body of the side that is intended to accommodate easily accessible necklaces or other flexible articles includes protrusions that cause at least the flexible portion of the article to be raised away from the base of that side of the body to permit a user to grasp easily the article with fingers. These protrusions can allow single flexible articles to be grasped at a place along the article for removal of that article from the case.

The interior of the opposite side of the case can be provided with compartmentalized sections that will accommodate individual rings, earrings, charms or the like. The cover of that side of the case is also provided with a resilient surface that, when closed against the base, will hold the articles in the compartment where they were stored.

These and other features of the invention will be shown and described with reference to the attached drawings which are representative of the structures that are intended and are provided for illustrative purposes and not for purposes of limitation.

BRIEF DESCRIPTION OF DRAWINGS

FIG. 1 is a perspective illustration of one form of the present invention showing the case from the locking mechanism edge.

FIG. 1A is an enlarged showing of the exterior of the locking mechanism showing the identification of one side of the case and the lock in an unlocked position.

FIG. 1B is an enlarged showing of the exterior of the locking mechanism showing the identification of the side opposite to that of FIG. 1A.

FIG. 1C is an enlarged showing of the exterior of the locking mechanism showing indicators for LOCKED and UNLOCKED position.

FIG. 2 is a perspective illustration of the case and showing the single finger operation for the opening of the case.

DETAILED DESCRIPTION OF THE PREFERRED EMBODIMENTS

Figure 3:
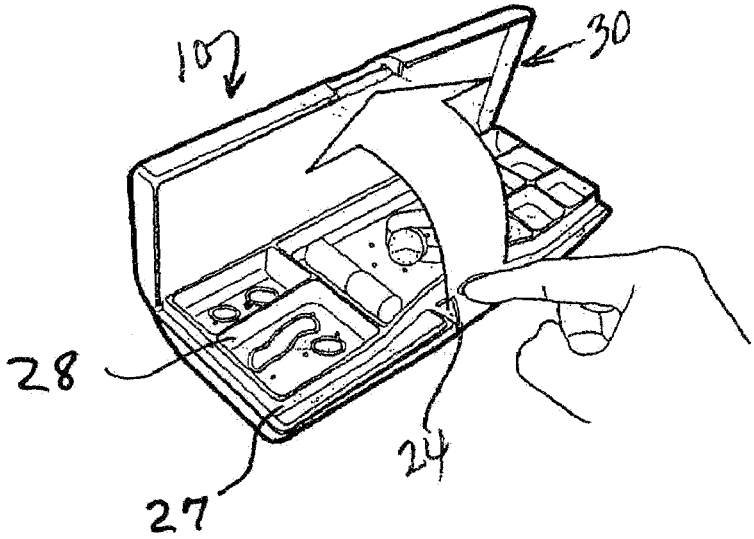
FIG. 3 is a perspective illustration of the case with one cover opened and illustrating the single finger opening of the case.

The foregoing drawings and description of the essence of the present invention should convey to a person skilled in this art the features of the invention. The case as illustrated and as described so far has been related to the use of the case for carrying and storing items including, but not limited to, jewelry. It should be understood that the case can be used for that same purposes in storing and carrying a wide variety of articles including fishing lures, small fasteners or any article having a leader and a clasp.

In FIG. 1 the case 10 is shown in a closed position. The surface 12 of the case as shown is adapted to accommodate a name tag or the like at 14 for identification of the manufacturer, owner or the products enclosed. The latching mechanism is shown at 16 and it should be understood that a hinge mechanism would be at the edge 18 away from the latch.

FIG. 1 A is an enlarged showing of the latching mechanism 16 illustrating an identification tab 20 for the side of the case and its contents; in the illustration shown the side would be for separate articles such as rings, and the like. The identification tab 20 also is the release button for the cover of the case on that side. Also shown is the locking lever 22 that will be further described hereinafter.

FIG. 1 B is an enlarged showing of the opposite side of the case and shows the latching mechanism 16 and an identification tab 24 and release button for this side of the case and the locking lever 22.

FIG. 1C is an enlarged showing of the front of the latching mechanism and locking lever 22 illustrating the locking lever in the LOCKED position represented by a closed padlock 26*a* and in an UNLOCKED position represented by the padlock 26*b* in an opened position.

FIG. 1 C shows the front view of the latching mechanism which is comprised of a first latch release 23*a* and a second latch release 23*b*. The latching mechanism as described herein is designed to allow one cover to be opened at a time. The latch mechanism works in conjunction with a catch (not shown) that is integrated into each cover. When the release mechanism is pressed, the latch release travels the distance of the gap 25 shown in FIG. 1C and the affected cover opens. The latch release must travel approximately the full distance of the gap 25 to release the cover. Thus, if both release latch releases were simultaneously depressed, neither would travel the full gap distance and neither cover would be opened.

FIG. 2 illustrates the operation of opening the case by a finger pressed against the identification tab 20 or 24, depending upon which side of the case is facing UP. The case is easily opened by simply pressing on the tab to activate the latch release and the cover opens under its biased/damped hinge system.

FIG. 3 illustrates the case opened after the tab 24 has been pressed. In this drawing, the side of the case shown opened is a side for accommodating single or loose articles such as rings, bracelets, watches, or earrings. The interior of the first storage side 27 of the body includes partitions 28 that separate the articles. The inside surface of the cover 30 will be described later.

Figure 4:
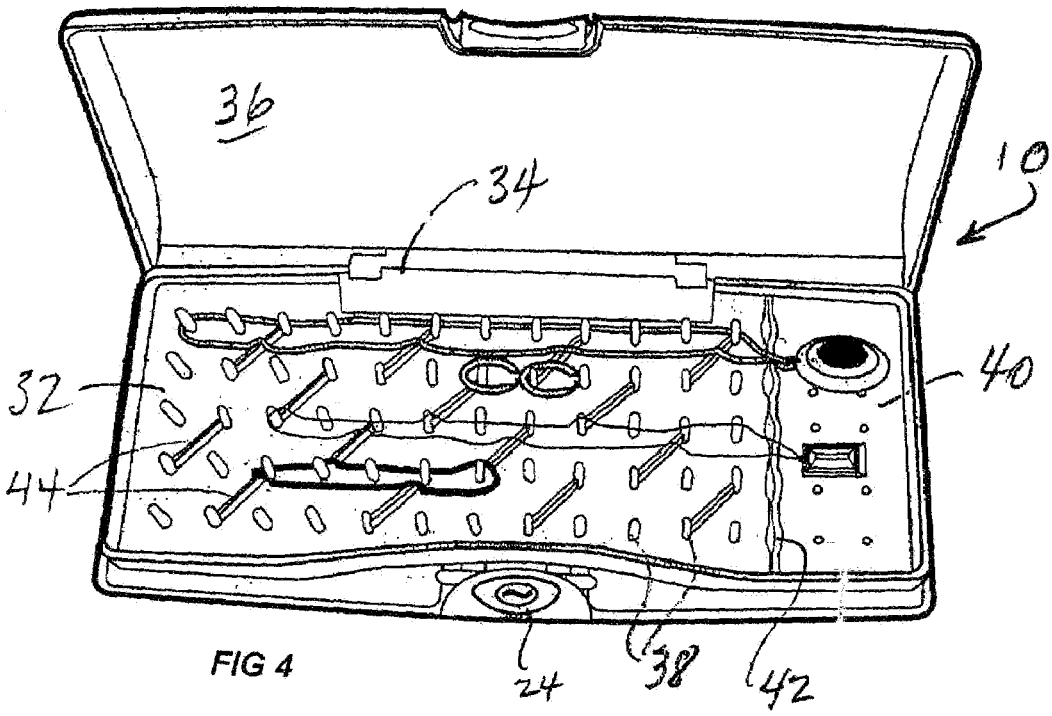
FIG. 4 is a perspective illustration showing the side of the case for accommodating flexible articles and illustrating the prongs and protrusions that permit placing of a flexible article and providing access to retrieving that article.

FIG. 4 is a perspective view illustrating the opposite, second storage side 29 of the body of the case adapted to accommodate flexible articles and pendants, or the like. In this view, the hinge 34 is shown (not in detail) at least partially enclosed by the body. Within the interior 32 of this side 29 of the body, a series of prongs 38 are provided for lacing the flexible materials against some barriers. The prongs are made of a soft flexible material that can bend slightly so as to not damage the articles laced against them. The prongs may be tapered slightly to assist in allowing the articles to fall into or be withdrawn from the base at that side. At one end of this side 29 of the body an area 40 is provided for accepting a charm or pendant attached to a flexible article and a barrier 42 can be provided to separate the articles within the area from the area where the flexible articles are laced. Spaced within the area where articles are laced are a plurality of short walls 44 that raise a portion of the flexible article above the base to provide for easy removal of fine chains or the like from the base of the case.

Figure 5:
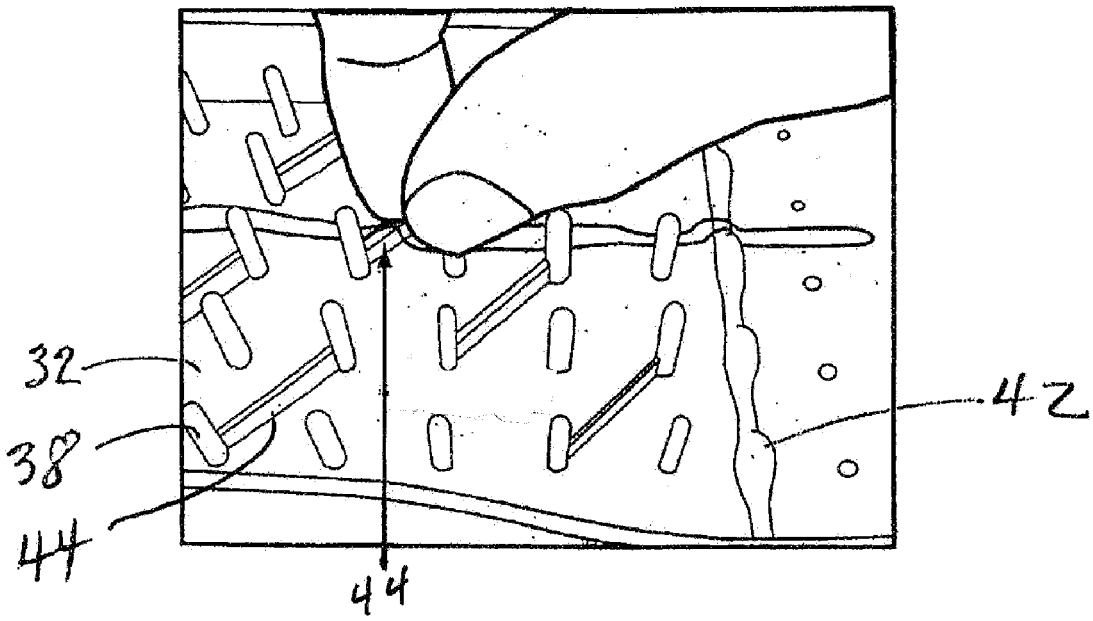
FIG. 5 illustrates the access to retrieving an article from the case with finger tips.
Figure 6:
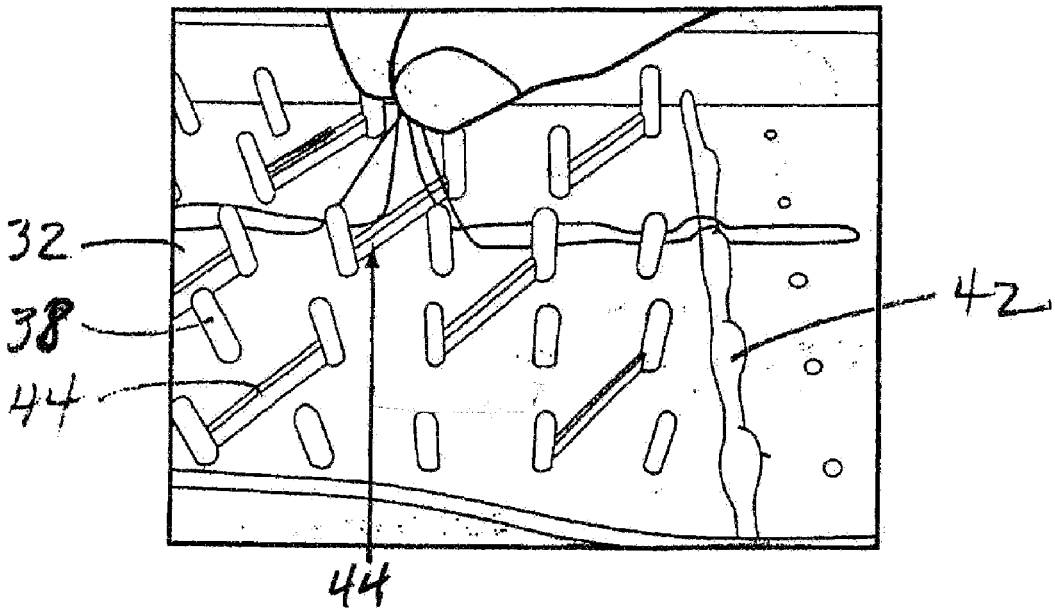
FIG. 6 illustrates the removal of an article from the prongs and protrusions.

FIG. 5 and FIG. 6 illustrate enlargements of the prongs 38 and the short walls 44 and show the ease of access to the flexible articles by fingers for removing the articles from the case. The short walls could also provide easy access to articles that are partially flexible or inflexible.

Figure 7:
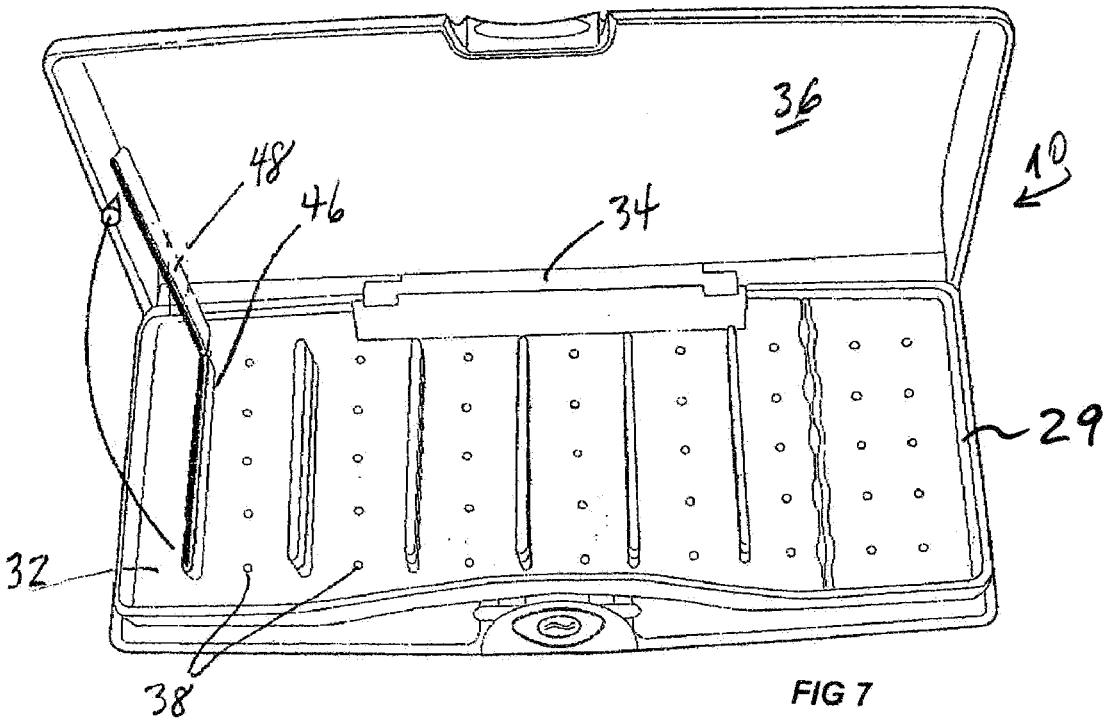
FIG. 7 is a perspective view showing one form of retainer for flexible articles.

FIG. 7 is an illustration of one form of apparatus for holding flexible articles in place within the case 10. As shown, the prongs 38 are placed within the body of the case for lacing flexible articles and/or separating all articles. A series of long walls 46 with mating bars 48 are placed along the base 32 of the second storage side 29; the bars 48 are hinged to the walls 46. With this system, the flexible articles are held in place within this side 29 of the body when the bars 48 are hinged down against the walls 46 and the case cover is closed. The walls and bars may be made of soft plastic or may have soft plastic surfaces that encounter the flexible articles.

Figure 8:
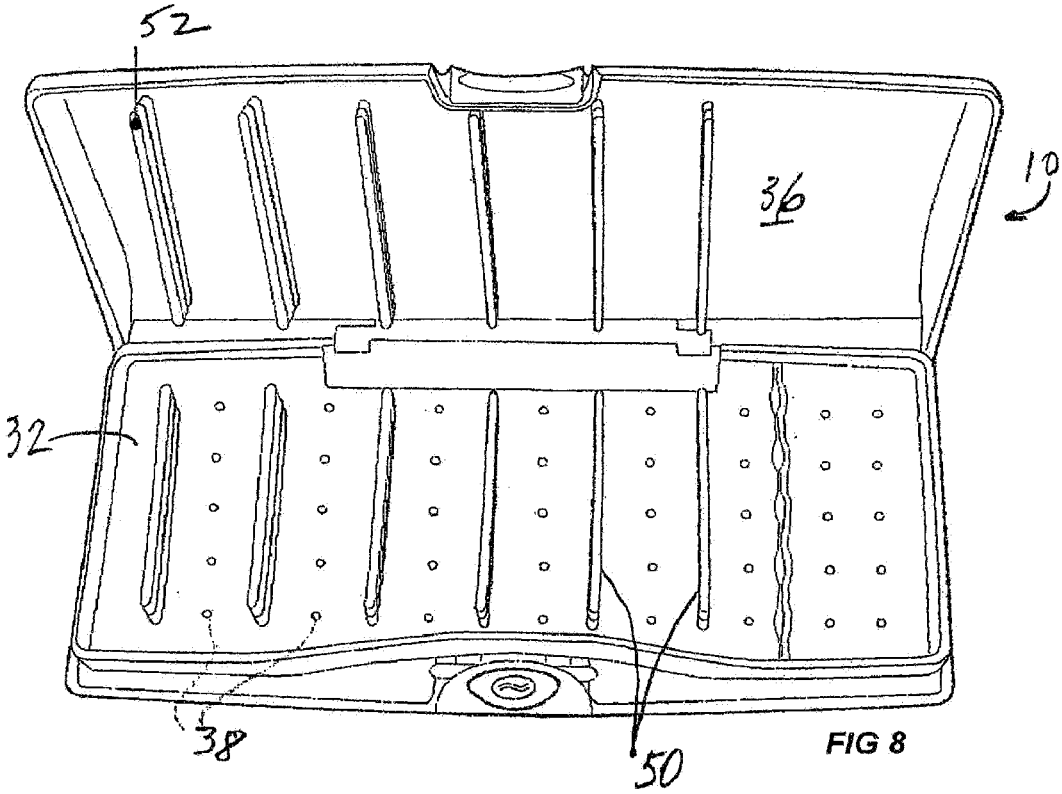
FIG. 8 is an alternative form for the retaining mechanism of the present invention.

FIG. 8 illustrates another form of apparatus for holding the flexible articles in place. As here illustrated, a series of barriers 50 are provided on the base 32 of one storage side of the case and a mating series of barriers 52 are provided on the interior of the cover 36. The mating barriers are spaced between the prongs 38. When the cover 36 is closed on the enclosed flexible articles, the two barriers engage each other and enclose any portion of a flexible article positioned within that side of the case.

Figure 9:
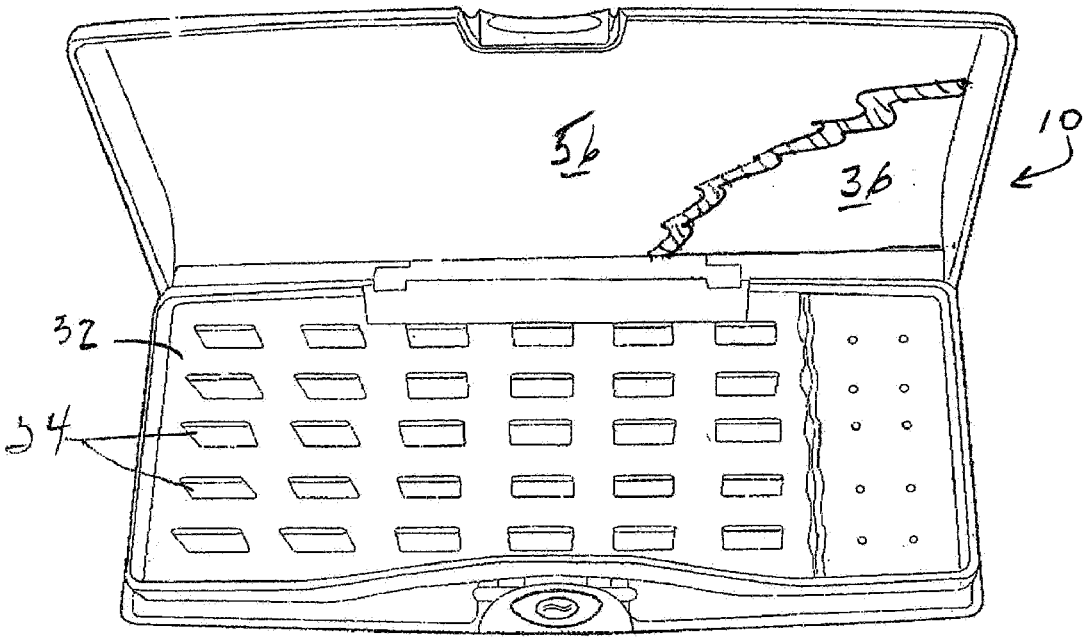
FIG. 9 is a perspective view of another alternative form for the separating means within the side of the case adapted to accommodate flexible articles.

FIG. 9 illustrates yet another variation of the means for securing flexible articles within the case. As here illustrated, the prongs 38 of previous examples are replaced with wall structures 54 that serve as means against which flexible articles may be woven to position such articles within the case. In this form of the invention, the interior surface of the cover 36 is provided with a compressible surface 56 extending along the entire surface of the cover. As shown in FIG. 9 a portion of the compressible surface 56 is cut-away and showing the interior of the cover 36. With this form of the present invention, a flexible article laced within this side along the wall structures 54 will be maintained in place by the compressible surface 56 when the cover is closed.

Figure 10:
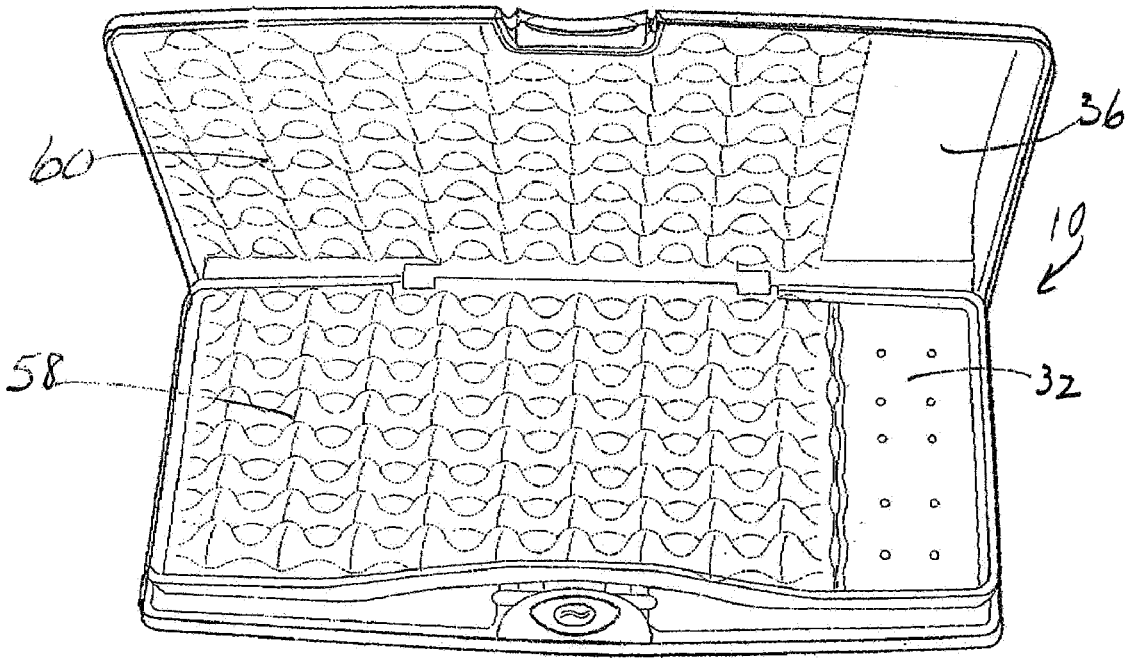
FIG. 10 is another alternative form for separating and retaining flexible articles within the case.

FIG. 10 illustrates another alternative form for the maintaining of flexible articles within the case. In this illustration, a conventional "egg crate" structure is attached to both the base 32 of this side of the body and the cover 36 with one part of the egg crate 58 on the body and the other part of the egg crate 60 on the cover 36. The undulations within the egg crate 58 on this side 29 of the body permit the flexible articles to be laced along the case so that when the cover 36 is closed, the egg crate 60 of the cover presses against the egg crate 58 and secures the flexible articles in place.

Figure 12:
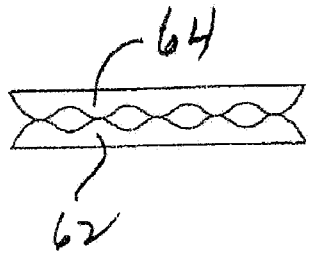
FIG. 12 is a side view of the cooperation of the alternative form as shown in FIG. 11.
Figure 11:
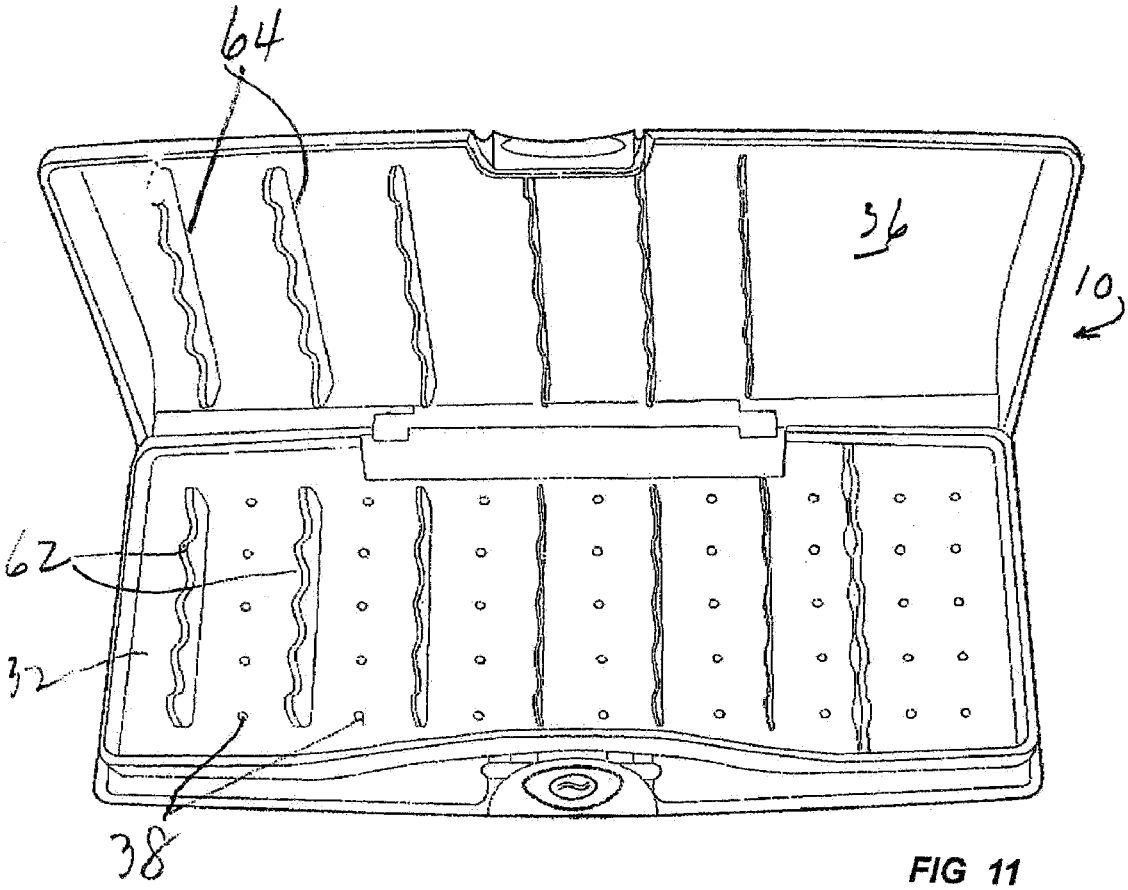
FIG. 11 is another alternative form for separating and retaining flexible articles.

FIG. 11 and FIG. 12 illustrate yet another alternative form for the securing mechanism of the present invention. As here illustrated, a plurality of rippled barriers 62 in the base 32 of this side 29 of the body are spaced between prongs 38 and a plurality of mating rippled barriers 64 are in alignment and placed on the interior of the cover 36. The ripples in the barrier 62 permit flexible articles to be woven along the case in a manner to separate the strands of the articles. As illustrated in FIG. 12, these rippled barriers 62 and 64 mate when the cover 36 is closed against the base to secure the articles in place.

Figure 13:
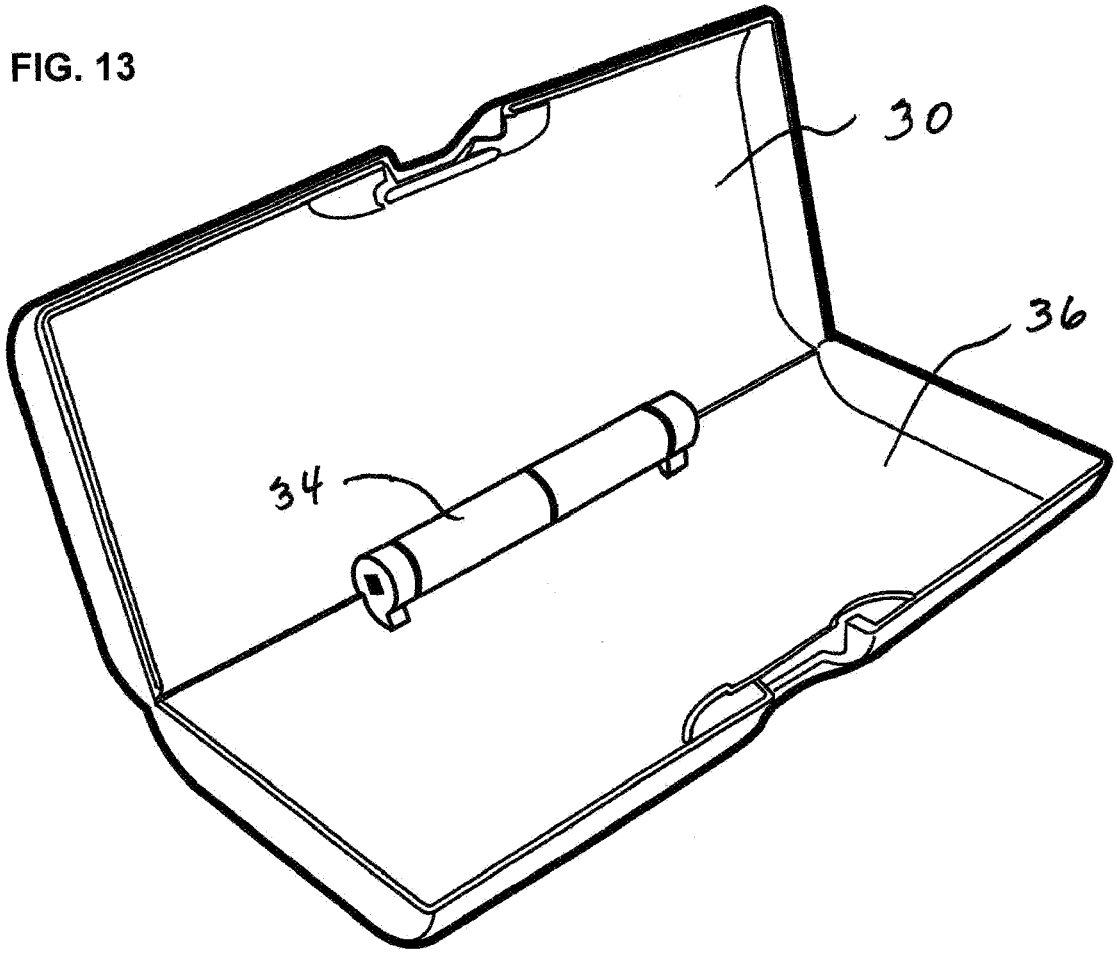
FIG. 13 is a perspective view of the case shown without the storage body insert for clarification purposes.

FIG. 13 illustrates the case before installation of the body and is shown for ease of understanding. The first cover 30 is connected to the second cover 36 via a hinge 34. As described herein, the hinge is designed to have a biasing or damping feature which allow the cover to be opened slowly when a latch release mechanism is engaged.

Figure 14:
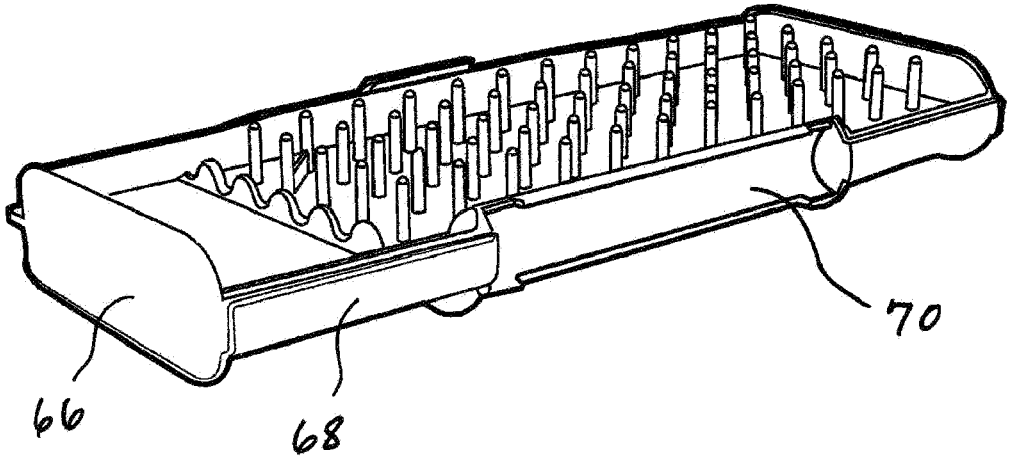
FIG. 14 is a perspective view of the storage body removed from the case for clarification.

FIG. 14 shows a perspective view of the body 66 before it is attached to the covers of the case. This illustration clearly shows the hinge side 68 of the body and the hinge sleeve 70 that partially encloses the hinge upon assembly. The hinge sleeve allows the body to remain in a fixed position relative to one cover while the other cover is opened.

Figure 15:
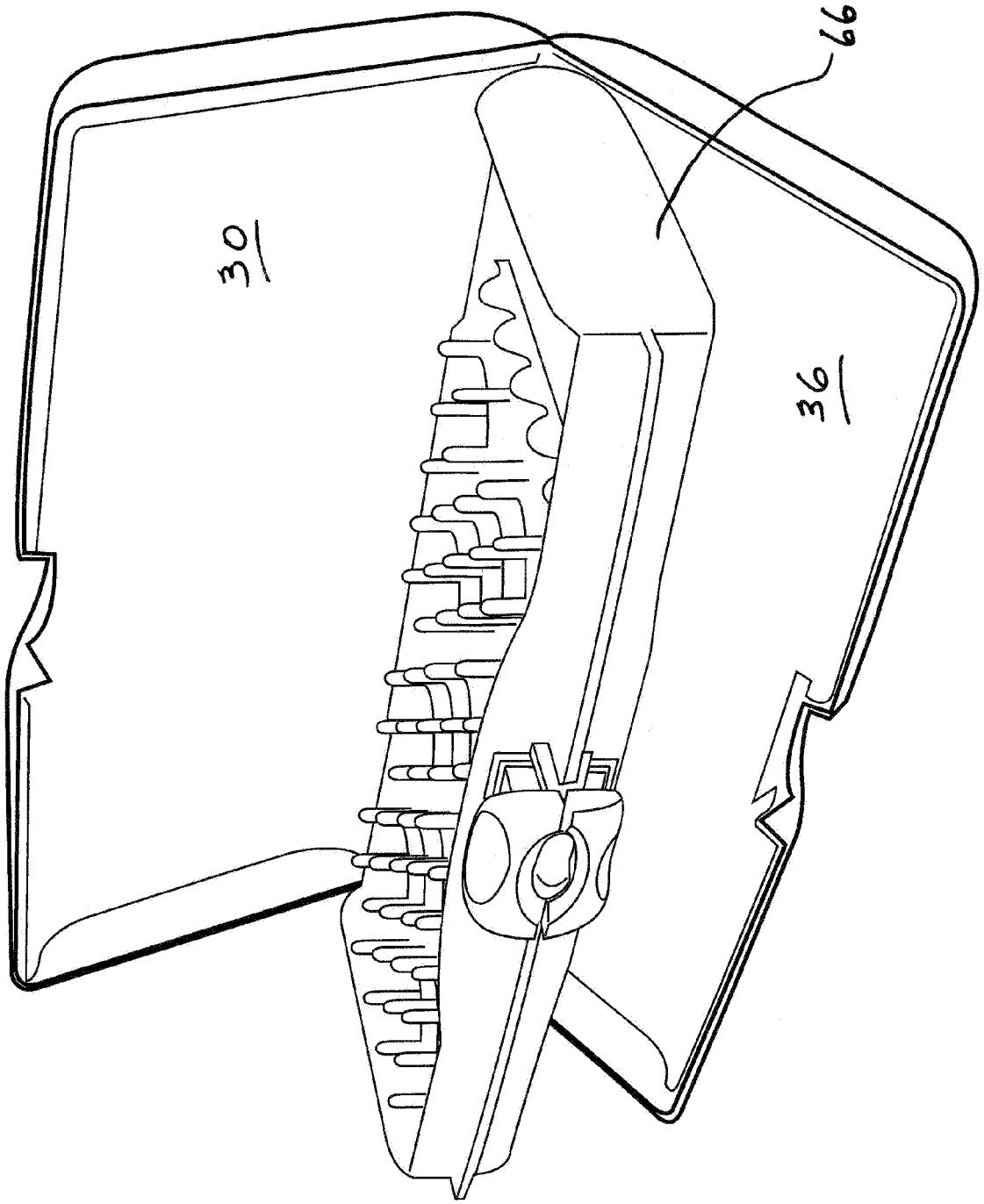
FIG. 15 is a perspective view of storage body in the case with both covers opened for clarification purposes.

FIG. 15 shows the body 66 rotatably attached to a hinge (not shown) between two case covers. It should be noted that this illustration is for explanatory purposes only and under ordinary conditions, only one cover would be opened at a time.

CONCLUSIONS, OTHER EMBODIMENTS, AND SCOPE OF INVENTION

In each of the alternative forms of securing means and in the securing means for the cover 30 that is adapted to accommodate rings or other small articles, the interior surfaces of the base of the body can be formed from flexible and compressible material, such as foam plastic, and the interior surfaces of the covers are covered with similar flexible and compressible plastic materials.

Embodiments of the present invention are shown with a shallow case with each side being only as deep as is needed to accommodate the intended articles. When so formed the case is easily stored within a bureau or chest as well as within traveling luggage. The hard exterior surface of the case prevents damage to the articles within the case. The flexible prongs or pegs prevent necklaces from tangling. The "one handed" cover opening by just pressing a push button allows for ease opening of the case. The slow damped opening of the cover as provided by the hinge system allows for opening of the case without moving or shocking the articles into a possible tangle. The short walls and other protrusions allow for ease of removal of fine chains or necklaces. The storage area for charms and pendants attached (or unattached) to chains allows for the flexible articles to be stored without removing the charm or pendant from the article. The interlocking latch system prevents the case from having both covers opened at the same time; the latch has a gravity activated element that prohibits a second, cover from being opened when another cover is already open.

The case as illustrated has smooth radiused edges and is compact to permit it to be easily "stuffed" into smaller spaces and can be placed within a purse or the like. The double sided case stores all sorts of jewelry as well as other cosmetics and accessories. The icons on the latches easily identify the type of articles stored within that side of the case. The locking system allows the case to be securely closed and locked during travel. The durable hard exterior protects the enclosed jewelry and the soft pliable plastic and foam interior protects the enclosed articles. The material from which the case may be constructed, inside and outside, permits the case to be easily cleaned should it become soiled.

As previously stated, the case can be used to accommodate a variety of articles and is not restricted to the use as a jewelry case. Any flexible article can be carried within the case and particularly those articles that can easily become tangled if not restricted in movement. The size of the case can be tailored to specific applications and should not be construed as a limitation.

In all embodiments of the present invention the body should include at least one side containing prongs extending from the base of the body towards an adjacent cover, the prongs being spaced to provide for accommodating objects, including short wall structures between at least two prongs for facilitating finger access to stored objects. The body may include flexible compressible material and the covers may include flexible interior surfaces cooperating with the flexible compressible material of the body to secure the stored objects.

The body may include flexible compartments for accommodating and separating individual objects from other objects and for accommodating elongated items attached to some individual objects. Compressible material within the body or the cover may contain egg crate like materials.

The latch mechanism shown and described herein is but one method to accomplish opening one cover while simultaneously securing the other cover in place. Other embodiments of a latch mechanism could be utilized to achieve this result. Similarly, many forms of locking mechanisms could be utilized to secure the covers and prevent inadvertent opening.

While certain preferred embodiments of the invention have been specifically disclosed, it should be understood that the invention is not limited thereto as many variations will be readily apparent to those skilled in the art and the invention is to be given its broadest possible interpretation based on the foregoing disclosure.

We claim:

1. A case for carrying and storing objects comprising:

a) a hinge;

b) a first cover and a second cover, said first cover rotatable attached to said second cover via said hinge, said first and second cover further comprising a catch;

c) a body, said body having a hinge side at a back of said body, a latch side at a front of said body, a first and second storage side for accommodating said objects, said first storage side opposite said second storage side of said body, and said body rotatable attached to said hinge between said covers;

d) a latch attached to said latch side of said body, said latch capable of securing both said covers at once, and further capable of latching one said cover while unlatching the other said cover.

2. The case of claim 1, wherein at least one of said storage sides comprises flexible prongs, said prongs extending from a base of said storage side toward one of said covers, said prongs being spaced within said storage side to accommodate stored objects.

3. The case of claim 1, wherein at least one storage side of said body includes flexible compressible material and an adjacent cover includes flexible interior surfaces cooperating with said flexible compressible material of said storage side to securely engage stored objects with respect to said body.

4. The case of claim 1 wherein said latch further comprises a first release component to unlatch said latch from said first cover and a second release component to unlatch said latch from said second cover.

5. The case of claim 4, wherein said latch includes mechanical interlocking structures that prevents simultaneous release of both of said release components.

6. The case of claim 4 wherein said hinge provides controlled movement of a cover away from the body upon activation of a latch release component.

7. The case as recited in claim 2, wherein at least one storage side includes a short wall between at least two of said flexible prongs.

8. The case of claim 1 wherein at least one said storage sides includes flexible compartments for accommodating and separating individual objects from other objects and for accommodating elongated items attached to some individual object.

9. A case for carrying and storing objects comprising:

a) a hinge;

b) a first cover and a second cover, said first cover rotatably attached to said second cover via said hinge;

c) a body, said body having a hinge side at a back of said body, a latch side at a front of said body, at least one storage side for accommodating said objects, said body rotatably attached to said hinge between said covers;

d) a latch at said latch side of said body; said latch mechanism capable of securing said first and second covers;

wherein said at least one storage side includes at least two first walls extending upward from the base of the storage side, said first walls creating a space interior thereto, and configured to mate with at least two second walls when said covers are closed.

10. The case as recited in claim 9, wherein at least one of said first or second walls comprises partially raised portions along said wall.

11. The case of claim 3 wherein said flexible compressible material within said body and said flexible interior surface of said adjacent cover are cooperating undulating surfaces that resemble "egg crates."

12. A case for carrying and storing objects comprising:

a) a hinge;

b) a first cover and a second cover, said first cover rotatable attached to said second cover via said hinge;

c) a body, said body having a hinge side at a back of said body, a latch side at a front of said body, at least one storage side for accommodating said objects, said body rotatable attached to said hinge between said covers;

d) a latch at said latch side of said body, said latch mechanism capable of securing said first and second covers;

e) said at least one storage side comprising at least two flexible prongs, said prongs extending from a base of said storage side toward one of said covers, said prongs being spaced within said storage side to accommodate objects;

f) said at least two flexible prongs further connected by a short wall structure for facilitating finger access to stored objects.

13. The case of claim 1 wherein said hinge is a damped biasing hinge.

* * * * *